US005613604A

United States Patent [19]

Maeng

[11] Patent Number: 5,613,604

[45] Date of Patent: Mar. 25, 1997

[54] GOLF BAG WITH WEIGHTED SUPPORT STAND

[76] Inventor: Seop Maeng, 709-4 Gorimri, Yongin-Eup, Yongin-Gun, Kyongi-Do, Rep. of Korea

[21] Appl. No.: 393,172

[22] Filed: Feb. 23, 1995

[30] Foreign Application Priority Data

Feb. 24, 1994 [KR] Rep. of Korea ..... UM 3415
Apr. 15, 1994 [KR] Rep. of Korea ..... UM 7900

[51] Int. Cl.[6] ..... A63B 55/00; A63B 55/06

[52] U.S. Cl. ..... 206/315.7; 206/315.2; 206/315.3; 206/315.6; 248/96

[58] Field of Search ..... 206/315.3–315.7; 248/96

[56] References Cited

U.S. PATENT DOCUMENTS

| | | | |
|---|---|---|---|
| 1,757,471 | 5/1930 | Platt | 248/96 |
| 2,408,777 | 10/1946 | Holbrook | 206/315.7 |
| 2,749,069 | 6/1956 | Sandstrom | 248/96 |
| 4,778,136 | 10/1988 | Reimers | 206/315.7 X |
| 4,798,357 | 1/1989 | Cho | 206/315.7 X |
| 4,834,235 | 5/1989 | Solheim et al. | 206/315.7 |
| 4,949,844 | 8/1990 | Yang | 206/315.7 |
| 5,303,888 | 4/1994 | Seop | 206/315.7 X |
| 5,340,063 | 8/1994 | Hsieh | 206/315.7 X |
| 5,356,003 | 10/1994 | Gretz et al. | 206/315.7 |
| 5,415,285 | 5/1995 | Reimers | 248/96 X |

FOREIGN PATENT DOCUMENTS

| | | | |
|---|---|---|---|
| 25576 | of 1915 | United Kingdom | 248/96 |
| 157632 | 1/1921 | United Kingdom | 206/315.6 |
| 398550 | 9/1933 | United Kingdom | 206/315.6 |

*Primary Examiner*—Sue A. Weaver
*Attorney, Agent, or Firm*—Connors & Assoc.; John J. Connors

[57] ABSTRACT

A golf bag with a support stand including a weight member adapted to extend automatically the legs of the support stand in an upright or tilted position of the golf bag and automatically retract the legs upon transporting the golf bag. The golf bag also includes a holding member adapted to prevent the legs from being extended upon storing and carrying the golf bag and thereby obtain convenience in use. As the holding member is a hook and fabric type fastener.

8 Claims, 5 Drawing Sheets

INVENTOR'S PREVIOUS
GOLF STAND

GOLF BAG WITH WEIGHTED SUPPORT STAND

BACKGROUND OF THE INVENTION

1. Field of the Invention

The present invention relates to golf bags, and more particularly to golf bags with weighted support stands wherein a pair of legs are movable between an extended position and a retracted position.

2. Background Discussion

There have been proposed various golf bags which have legs movable between extended and retracted positions. In particular, there has been proposed a golf bag including a weight member adapted to move legs between extended and retracted positions. This golf bag is disclosed in the Korean Utility Model Application No. 92-14606 filed in the name of the inventor.

Inventor's Previous Support Stand for a Golf Bag

The golf bag invention disclosed in Korean Utility Model Application No. 92-14606 is illustrated in FIG. 6. In this golf bag 100 a slide member 101 having a slide slot 102 is attached to each leg 106 of the golf bag. A pair of actuating members 108 and 110 are coupled at their upper ends to the legs 106 such that each upper end is received in one slide slot 102 of the slide members 101. The weight member 104 is coupled to the lower ends of the actuating members 108 and 110. By this construction, the legs 106 can move between extended and retracted positions as the actuating members 108 and 110 slide along the slide slots 102 by virtue of the weight of the weight member 104. However, such a construction is more or less complex, and thereby expensive. Since the actuating members 108 and 110 slide along the slide slots 102, it is difficult to obtain smooth operation of the actuating members. This results in difficulty in achieving easy movement of the legs 106 between extended and retracted positions.

SUMMARY OF THE INVENTION

It is one object of the present invention to overcome the above-mentioned disadvantages encountered and to provide a golf bag with a support stand including a weight member attached to the upper ends of legs of the support stand that automatically extends and retracts the legs. Another object of the invention is to provide a golf bag with a support stand including a holder adapted to hold firmly the legs of the support stand at their retracted position.

The golf bag of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include ease of manufacture, convenience of use, simplified construction of the support stand, reduction of the labor and manufacturing cost, and the achievement of smoother extension and retraction movements of the legs.

The first feature of the golf bag of this invention is that it includes a bag body and a pair of legs pivotally mounted to the bag body. There is a holder for the legs to retain the legs in a retracted position. The holder may be in the form of a holding strip. The holding strip preferably has one end attached to a portion of the bag body adjacent to lower ends of the legs, with a fastener at an opposite end to detachably couple the strip in position. The preferred fastener is of the hook and fabric type.

The second feature of this invention is a leg actuator mechanism comprising a weight member connected to an extension member at or near the end of the leg that is pivotally attached to the bag. Each extension member has a free end extending from an upper end of each leg, and each extension member has an angle of about 10° to about 60° with respect to the longitudinal axis of its corresponding leg. The weight member is connected to each of the free ends of the extension members. With movement of the bag from a tilted to an upright position, the leg actuator mechanism is adapted to move the legs from an extended position to a retracted position.

The third feature is that the leg actuator mechanism has several different embodiments. In one embodiment, the leg actuator mechanism includes a longitudinally extending club receiving member pivotally mounted to the free ends of the extension members. The club receiving member is adapted to receive at least one golf club. In another embodiment, the leg actuator mechanism includes a ball pocket connected to both the ends of the extension members. This ball pocket is adapted to receive a plurality of golf balls therein.

The fourth feature is that a support member is adapted to support the club receiving member such that it prevents the club receiving member from moving away from the bag body while allowing the club receiving member to move vertically.

BRIEF DESCRIPTION OF THE DRAWINGS

The preferred embodiments of this invention, illustrating all its features, will now be discussed in detail. These embodiments depict the novel and non-obvious golf bag of this invention as shown in the accompanying drawing, which is for illustrative purposes only. This drawing includes the following figures (FIGS.), with like numerals indicating like parts:

FIG. 2*a* shows the condition when legs are in their extended position by a weight member, and FIG. 2*b* shows the condition when legs are maintained at their retracted position by the weight member upon carrying the golf bag.

FIG. 5*a* shows the condition when legs are in their extended position by virtue of the weight of a golf club received in a club receiving member, and FIG. 5*b* shows the condition when legs are in their retracted position by virtue of the weight of the golf club upon carrying the golf bag.

DETAILED DESCRIPTION OF THE PREFERRED EMBODIMENTS

Figure 1:
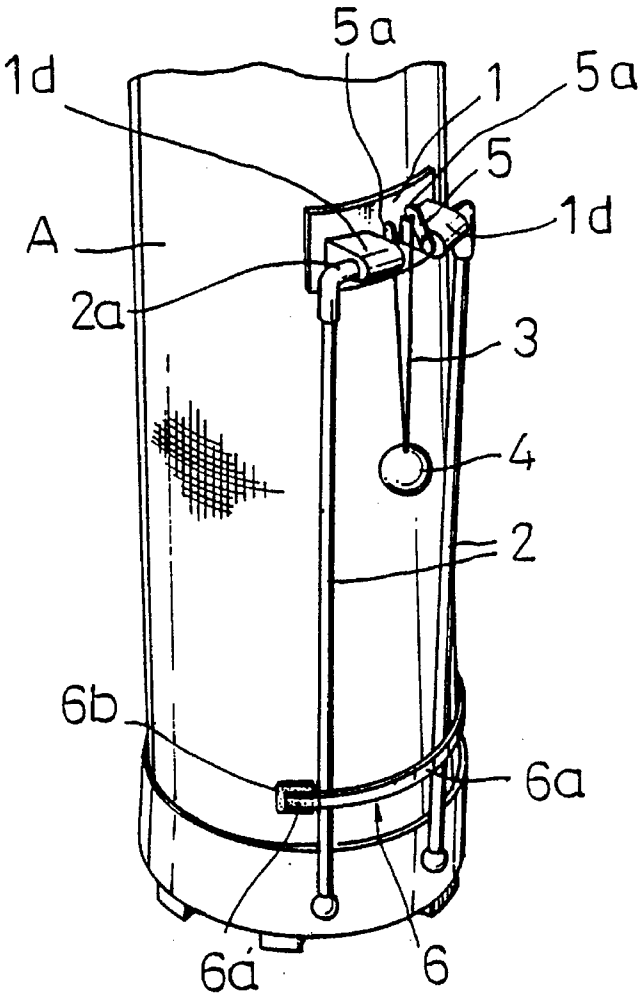
FIG. 1 is a perspective view of a golf bag with a support stand in accordance with one embodiment of the present invention.

Referring to FIG. 1, there is shown a golf bag with a support stand in accordance with one embodiment of the present invention. The golf bag comprises a bag body A with a pair of support legs 2 constituting a part of the support stand. The support legs 2 are pivotally mounted at their upper ends 2*a* to a bracket 1 attached to the bag body A.

The upper ends 2*a* are bent at a 90° and each passes through a support element 1*d* of the bracket 1, terminating in an extension member 5 which has a free end 5*a* angularly pointing toward the bag body A. A weight member 4 is connected to the extension members 5 by means of strings 3. The torque required for the extension of legs 2 is determined by the tilt angle θ and length of the extension members 5. In other words, where each extension member 5 has a large tilt angle θ and a large length, a large torque is generated. It is preferred that each extension member 5 has a tilt angle of about 10° to about 70° with respect to its corresponding leg 2. More preferably, the tilt angle of each extension member 5 is preferably from about 25° to about 60°.

Figure 3:
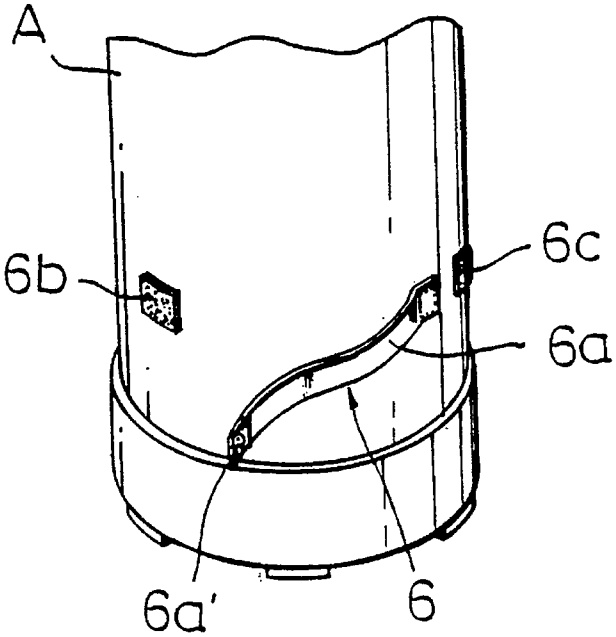
FIG. 3 is a partial perspective view of the golf bag showing a holding member in accordance with the present invention.

Attached to a portion of the bag body A adjacent the lower ends of legs 2 is a holding member 6 for firmly holding the legs 2 in their retracted position upon carrying or storing the golf bag. In order to firmly hold the legs 2 at their retracted position, the holding member 6 includes a holding strip 6*a* and a gripper 6*b* to which the holding strip 6*a* is detachably coupled. The holding strip 6*a* has a fixed end attached to the bag body A and the other end provided with a fastener portion 6*a*' detachably coupled to the gripper 6*b*. Another gripper 6*c* (FIG. 3) is attached to a portion of the bag body A adjacent the fixed end of the holding strip 6*a*. In the illustrated embodiment of the present invention, the grippers 6*b* and 6*c* are preferably sections of a pile fabric, and the fastener portion 6*a*' includes a plurality of hooks, to provide a conventional hook and fabric type fastener such as manufactured by Velcro Corporation.

The holding member 6 is attached to the lower portion of bag body A in order to eliminate any inconvenience caused by the undesired extension of the legs 2 upon storing the golf bag in the upright position or transporting the golf bag. The legs 2 can be held in their retracted positioned by attaching the fastener portion 6*a*' of holding strip 6*a* to the gripper 6*b* when the legs 2 are in the retracted position, thereby binding the legs 2 with the holding strip 6*a*. When the golf bag is to be used, the fastener portion 6*a*' of holding strip 6*a* is detached from the gripper 6*b* and then attached to the gripper 6*c*, so that the legs 2 can be released and moved to their extended position. Since the holding strip 6*a* is attached to the gripper 6*c* at this time, it is prevented from fluttering. Accordingly, it is possible to store conveniently the golf bag with the legs 2 in the retracted state by means of the holding member 6.

Figure 2A:
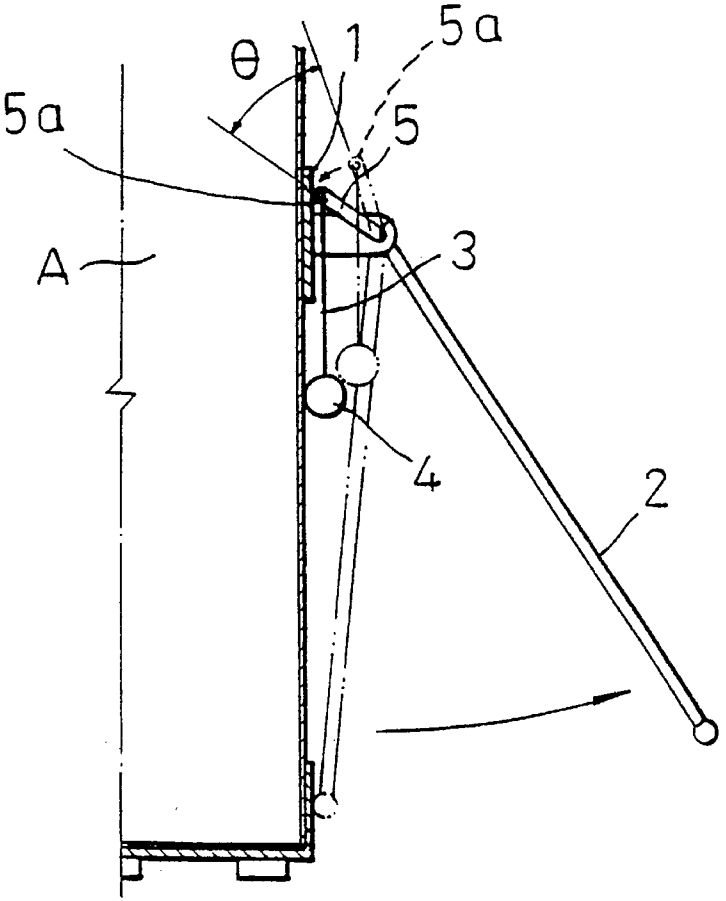
FIGS. 2*a* and 2*b* are partially-broken side views of the golf bag showing conditions of legs, where
Figure 2B:
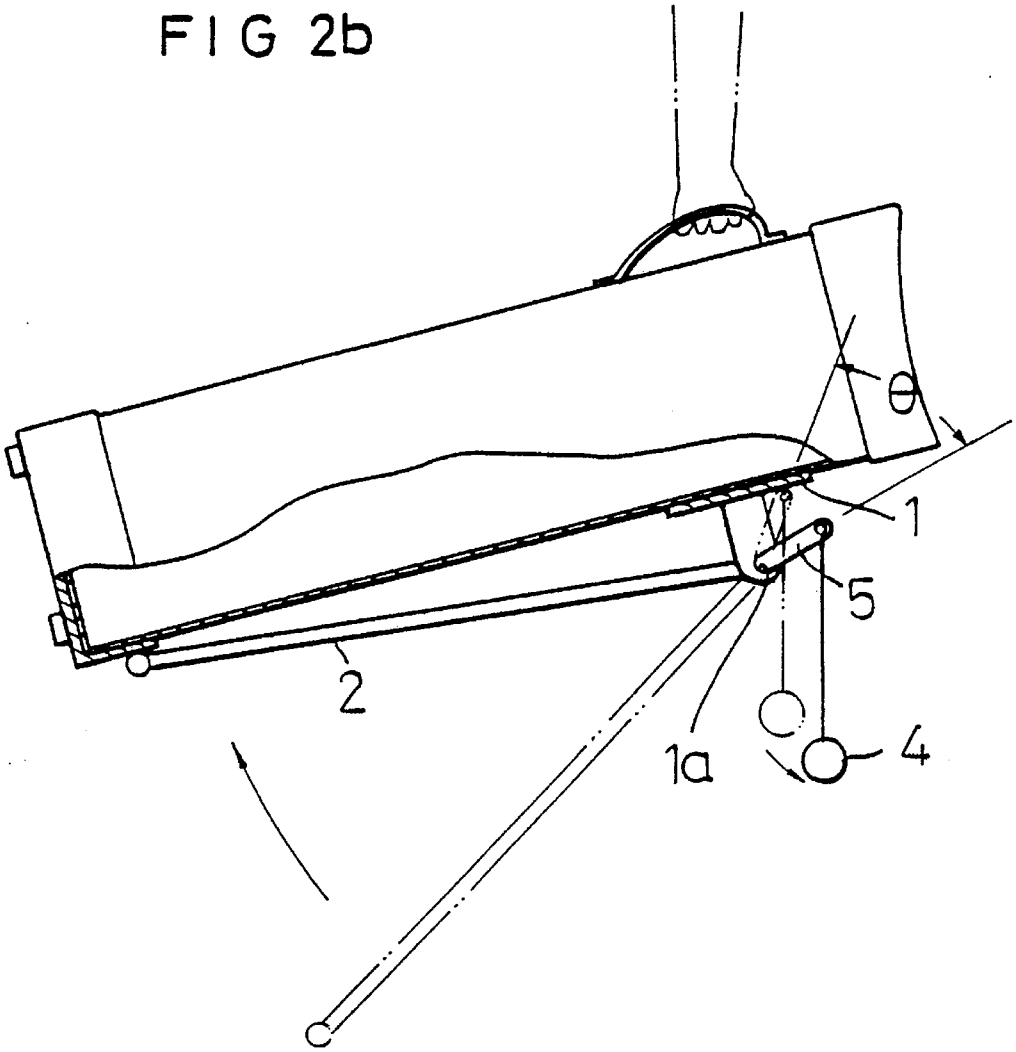

Operation of the golf bag with the support stand having the above-mentioned construction will now be described. When the golf bag is positioned in an upright position as shown in FIG. 2*a*, or tilted slightly, the legs 2 pivot about pivots points on the bracket 1 by virtue of the weight of the weight member 4. The extension members 5 simultaneously move inward toward the bag body A until they come into contact with the bracket 1, which serves as a stop. With these pivotal movements, the legs 2 move in a counter-clockwise direction as viewed in FIG. 2*a* to their extended position, as indicated by an arrow in FIG. 2*a*. In this state the golf bag can be stably maintained in its tilted position and rested on the ground. As shown in FIG. 2*b*, when a user lifts the golf bag up to carry it to another place, the weight member 4 pivots the legs 2 in a counter-clockwise as viewed in FIG. 2*b* and as indicated by the arrow. Consequently, the legs 2 are automatically retracted upon lifting and carrying the golf bag and come into contact with the bag body A as shown in solid lines in FIG. 2*b*.

The weight member 4 may be of the well-known construction such as a sphere as depicted in FIG. 2*a*, or it may be of other constructions. For example, in place of the spherical weight member 4, a ball pocket capable of receiving several golf balls may be used. In this case, the automatic extending and retracting movements of the legs 2 can be adjusted by adding or subtracting golf balls in the ball pocket, thereby making the ball pocket have a predetermined weight, as desired.

Figure 5A:
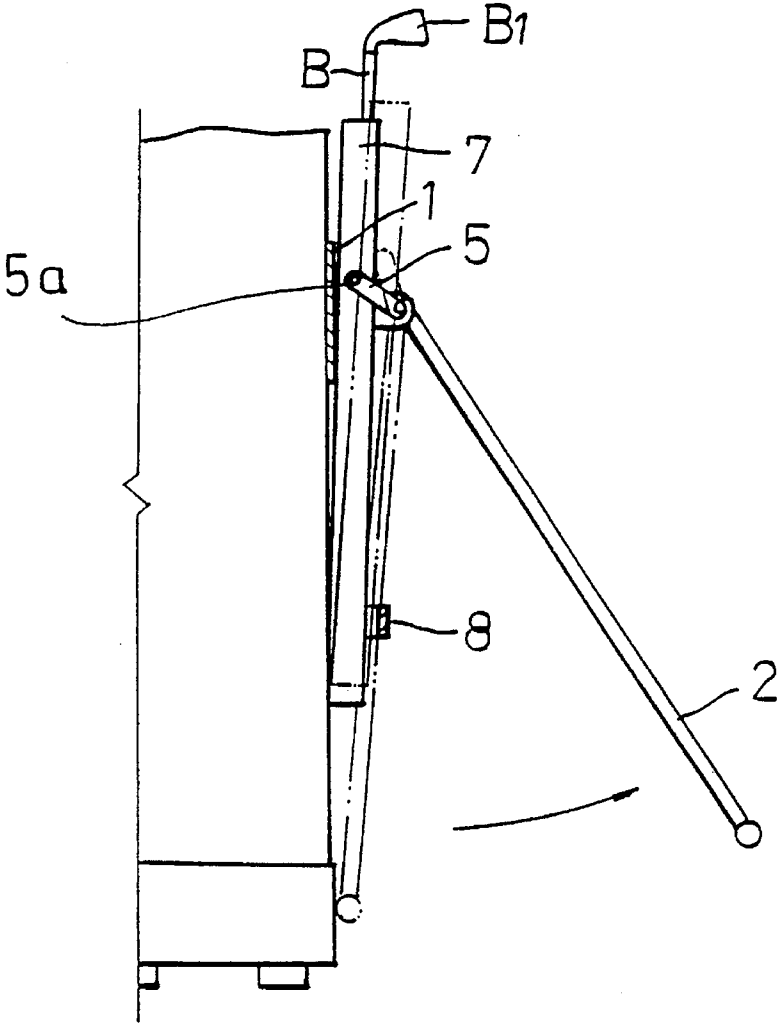
FIGS. 5*a* and 5*b* are partially-broken side views of the golf bag of FIG. 4 showing conditions of legs, where
Figure 4:
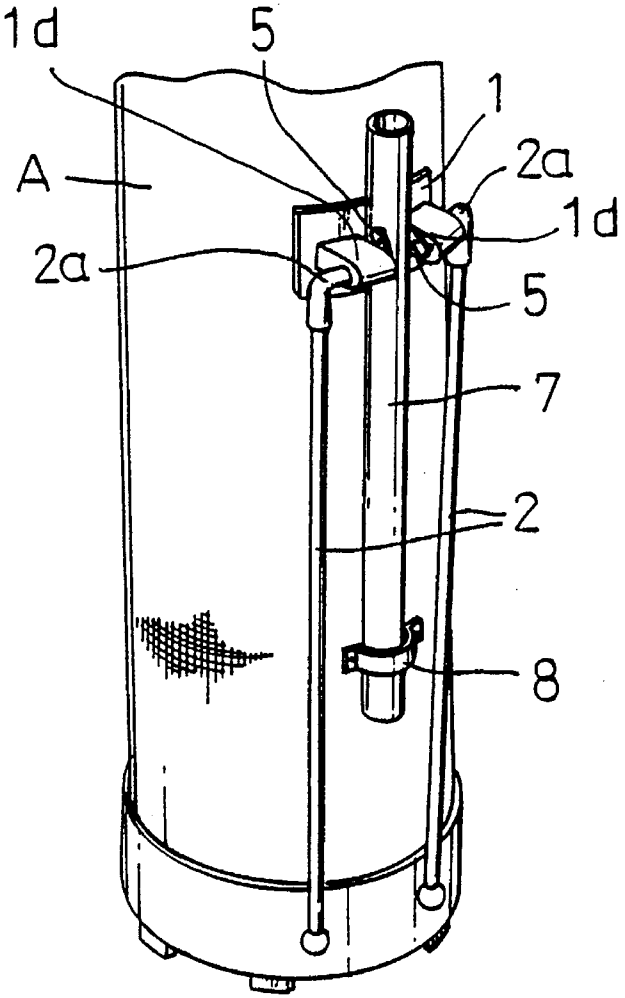
FIG. 4 is a perspective view of a golf bag with a support stand in accordance with another embodiment of the present invention.
Figure 5B:
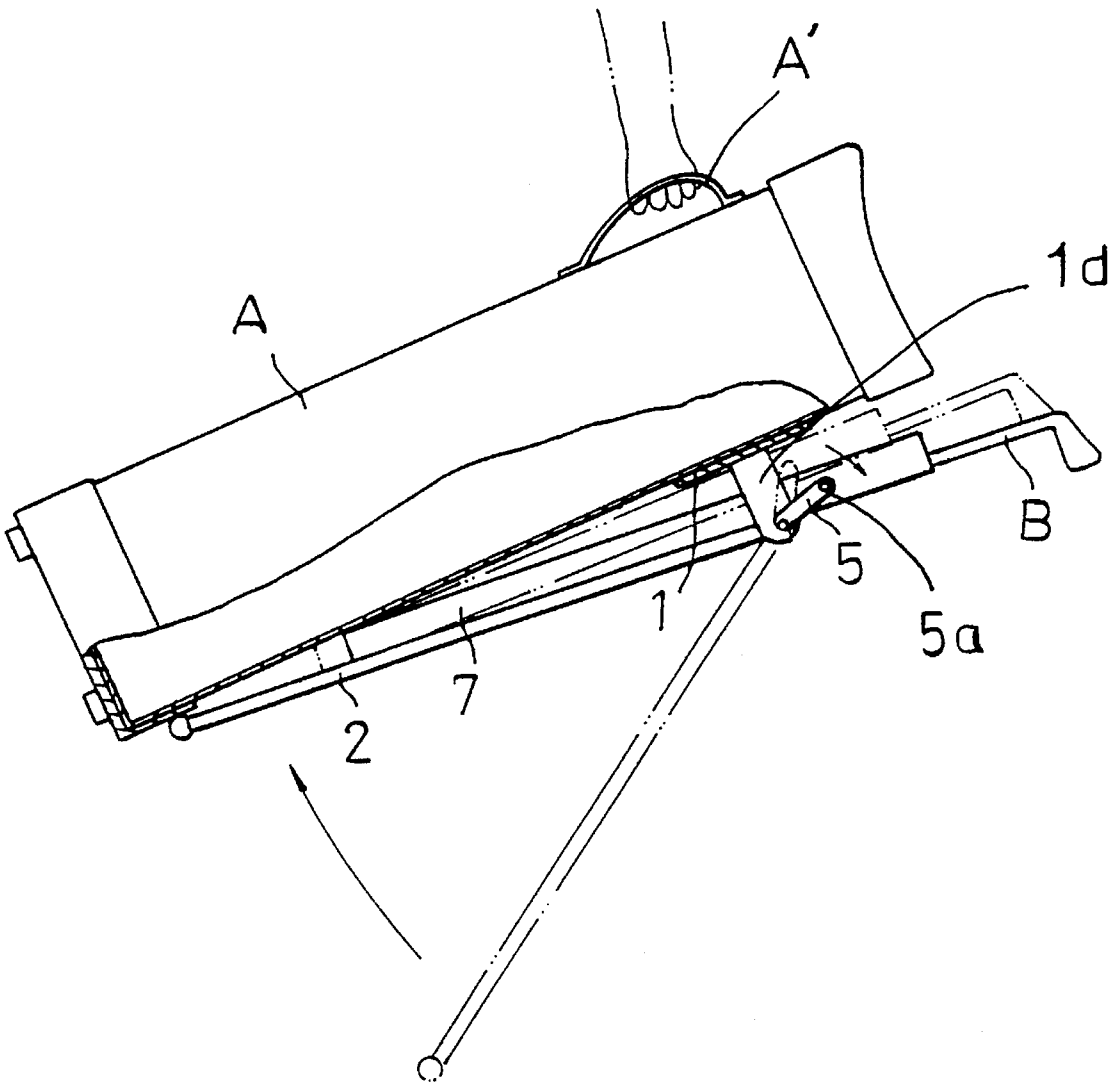
Figure 6:
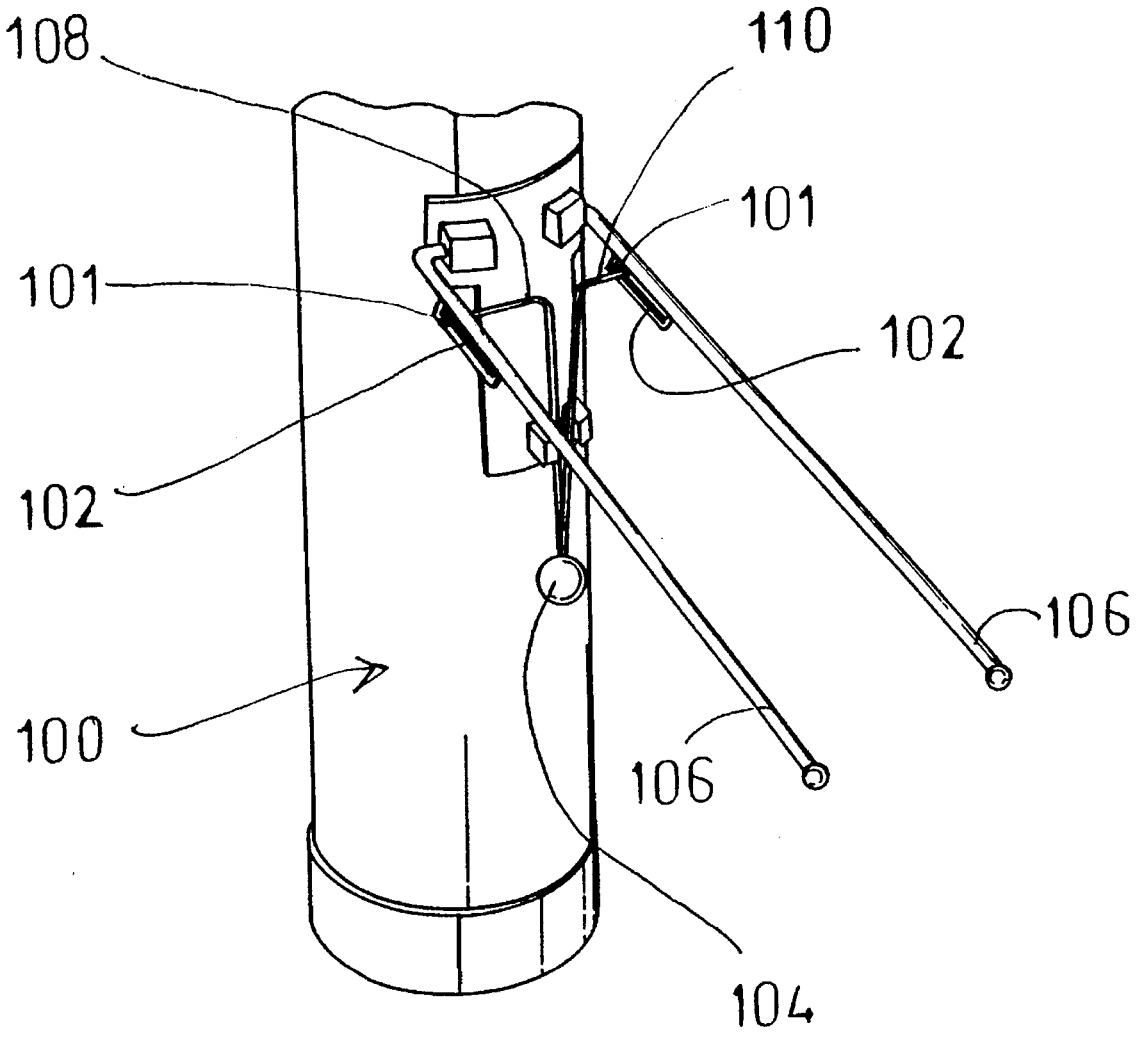
FIG. 6 is a perspective view of the inventor's previous support stand for a golf bag.

FIG. 4 and FIGS. 5*a* and 5*b* show a support stand in accordance with another embodiment of the present invention. This embodiment achieves automatic extending and retracting movements of the legs 2 and maintains these legs in their retracted position using a golf club as the weight. In accordance with this embodiment, the weight of the support stand can be reduced. Accordingly, it is possible to achieve greater convenience, ease of manufacture, and reduction of manufacturing cost.

The support stand of this embodiment has the same construction as that of FIG. 1 except that it includes a club receiving member 7 in place of the weight member 4 of FIG. 1. In FIGS. 4 and 5*a* and 5*b*, elements respectively corresponding to those in FIG. 1 are denoted by the same reference numerals. As shown in FIG. 4, a pair of support legs 2 are pivotally mounted at their upper ends to the bag body A by means of a bracket 1. Each leg 2 is provided with an extension member 5 angularly extending toward the bag body A. Pivotally mounted to the extension members 5 is the longitudinally extending club receiving member 7. The receiving member is simply a sheath into which the user places a golf club B.

In the illustrated embodiment, the club receiving member 7 has a predetermined diameter so that the head Bl of the golf club B upon being placed in the club receiving member 7 is prevented from passing through the club receiving member 7. Of course, the club receiving member 7 may have a size capable of receiving several golf clubs. The club receiving member 7 is supported and guides along its lower end by a support member 8, so that the lower end of club receiving member 7 is prevented from moving away from the bag body A. The support member 8 guides the club receiving member 7 to move vertically.

In accordance with this embodiment, the golf club B is selected from golf clubs in the bag to be used for the next hole, or golf clubs already used, or golf clubs being frequently used. This golf club B is positioned in the club receiving member 7 such that the head Bl thereof is pointing upward. As shown in FIG. 5*a*, with the golf bag in an upright position, or a predetermined slightly tilted position, the club receiving member 7 moves downward by virtue of the weight of the golf club B received therein. Accordingly, the legs 2, and attached extension members 5 to which the club receiving member 7 is pivotally coupled, pivot in a counter-clockwise as viewed in FIG. 5*a* until the the club receiving member 7 comes into contact with the bracket 1. As indicated by the arrow in FIG. 5*a*, because of the pivotal movement of extension members 5 produced by the weight of the golf club 5, the legs 2 move in a counter-clockwise direction as viewed in FIG. 5*a* to their extended position. In this state, the golf bag can be stably maintained in its upright or slightly tilted position. The center of gravity of the club receiving member 7 is at its upper portion near the head Bl of the golf club B in the club receiving member 7 by virtue of the weight of the head Bl. As a result, when the user lifts up the golf bag to carry it to another place, the extension members 5 pivot in clockwise direction as viewed in FIG. 5*b*. Simultaneously, the legs 2 pivot in clockwise as viewed in FIG. 5*b* such that they come into contact with the bag body A. In such a manner, the legs 2 are automatically retracted upon carrying the golf bag by its handle A'.

In accordance with this embodiment of the present invention, it is possible to eliminate any inconvenience caused by the extension of legs 2 when storing the golf bag in the upright position or transporting the golf bag. Specifically, by removing the golf club B from the club receiving member 7 to store the golf bag in the upright state, the legs 2 are automatically retracted toward the bag body A by virtue of the reduction in weight weight and shift in the center of gravity.

The presently illustrated embodiments may be modified. For example, the size and shape of the club receiving member 7 may be varied so that it can receive a plurality of golf clubs therein. Also, the club receiving member 7 may be constructed to receive other articles than golf clubs. Although the extension members 5 extend outward and upward in the illustrated cases, they may extend inward and downward. As apparent from the above description, the present invention provides a golf bag with a support stand including a weight member 4 adapted to automatically extend legs of the support stand when positioned in an upright or slightly tilted position and automatically retract the legs upon transporting the golf bag. The support stand of the present invention lends itself to simplified construction with reduced labor and manufacturing cost. Since the golf bag also includes a holding member 6 adapted to prevent the legs 2 from being extended upon storing and carrying the golf bag, convenience in use is attained. The present invention also provides a golf bag with a support stand including the club receiving member 7 adapted to receive a golf club therein, capable of achieving extending and retracting movements of legs of the support stand with a simplified construction which reduces the weight of the support stand. Since the legs 2 are retracted automatically upon removing the golf club B during storage, convenience in use is realized.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

I claim:

1. A golf bag comprising a bag body, a pair of legs, each leg having an upper end pivotally mounted to the bag body, and each upper end having attached thereto an extension member, each extension member terminating in a free end that angularly points toward the bag body, and a leg actuator mechanism including a weight member, said leg actuator mechanism connected to the extension members and adapted to extend the legs with movement of the bag to a generally upright position and retract the legs with movement of the bag to a generally tilted position.

2. The golf bag of claim 1 including a holder for the legs to retain the legs in a retracted position.

3. The golf bag of claim 1 where each of the extension members has an angle of about 10° to about 70° with respect to the longitudinal axis of each corresponding leg.

4. The golf bag of claim 1 where the weight member is connected to both the extension members at ends of the extension members.

5. The golf bag of claim 1 where the leg actuator mechanism comprises a longitudinally extending club receiving member pivotally mounted to the extension members.

6. The golf bag of claim 5 where the club receiving member is adapted to receive at least one golf club.

7. The golf bag of claim 5 where including a support member adapted to support the club receiving member such that it prevents the club receiving member from moving away from the bag body while allowing the club receiving member to move vertically.

8. A golf bag comprising a bag body, a pair of legs, each leg having an upper end pivotally mounted to the bag body by a bracket fixed to the bag body, an extension member attached to each upper end of each legs, each extension having a free end pointing toward the bag body, each of the extension members having an angle of about 10° to about 70° with respect to the longitudinal axis of each corresponding leg, and a leg actuator mechanism, including a weight member connected to the ends of the extension members which is adapted to extend the legs with movement of the bag to a generally upright position and retract the legs with movement of the bag to a generally tilted position.

* * * * *